United States Patent [19]

Parrent

[11] 4,269,575

[45] May 26, 1981

[54] AIR DOME WITH BAFFLE FOR FUEL PUMPS

[75] Inventor: Russell Parrent, Fairfield, Ill.

[73] Assignee: United Industrial Syndicate, Inc., New York, N.Y.

[21] Appl. No.: 30,780

[22] Filed: Apr. 17, 1979

[51] Int. Cl.[3] ..... F04B 11/00

[52] U.S. Cl. ..... 417/542; 138/26

[58] Field of Search ..... 417/471, 540, 542, 543; 138/26, 31

[56] References Cited

U.S. PATENT DOCUMENTS

| | | | |
|---|---|---|---|
| 1,809,394 | 6/1931 | Schweisthal | 417/543 |
| 3,213,878 | 10/1965 | Johnson | 417/542 X |
| 3,224,377 | 12/1965 | Hicks | 417/238 |
| 3,617,157 | 11/1971 | Phillips | 417/542 |

*Primary Examiner*—Philip R. Coe

*Attorney, Agent, or Firm*—Zalkind & Shuster

[57] ABSTRACT

A construction for an air dome is provided wherein the entrance area is substantially blocked off except for peripheral ports. It has been found that in fuel pumps, particularly where the fuel inlet port is below the air dome, that the flow of fuel into the dome can sometimes be at such a velocity that it washes out much of the air trapped within the dome and therefore defeats the air dome purpose. It has been found that the provision of a solid disk at the entrance to the air dome prevents such air washout, fuel entry being considerably restricted and confined to points at the disk edge. In particular, the use of such a disk in conjunction with an air dome of the type having longitudinal ridges, i.e., side flutes which normally are provided for the purpose of effecting fuel passage around the outside of the air dome, is used advantageously. Thus, fuel entry into the air dome to compress air therein is not washed out and the air dome remains effective. The invention effect is primarily for pumps where the inlet flow is directly towards the air dome.

3 Claims, 6 Drawing Figures

AIR DOME WITH BAFFLE FOR FUEL PUMPS

The invention is particularly intended for air domes of the kind shown in U.S. Patent to W. J. Hicks, No. 3,224,377, issued Dec. 21, 1965. The invention therein is for a fuel pump and an air dome combination such that the fuel pump may be mounted in an engine with the inlet either upwardly or downwardly, depending on the type of engine. The air domes are reversible within chambers in the fuel pump so as to provide a trap for air in either position of the pump. The sides of such air domes are fluted outwardly to provide spacings between the air domes and the chambers for fuel flow.

The aforementioned U.S. Pat. No. 3,224,377, is made of reference herein for any information needed to effect a clear understanding of the specific setting of the present invention.

A detailed description of the invention now follows in conjunction with the appended drawing, in which:

FIG. 1 reproduces a composite fragmentary sectional illustration of a fuel pump based on the aforementioned patent, illustrating the positions of the air domes in a fuel pump where the fuel inlet is below the air dome and axially directed to it.

Figure 1:
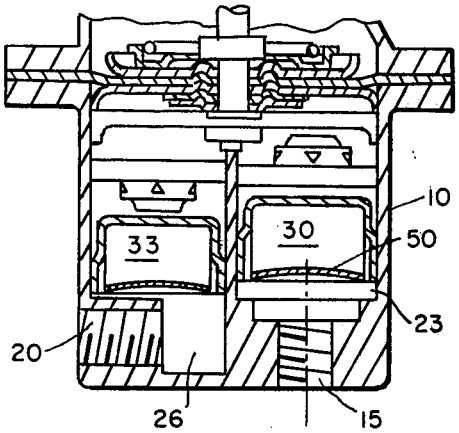

Referring to the drawing, FIG. 1 shows fragmentarily a fuel pump housing 10 having an inlet 15 and outlet 20 with an inlet chamber 23 and an outlet chamber 26.

Figure 2:
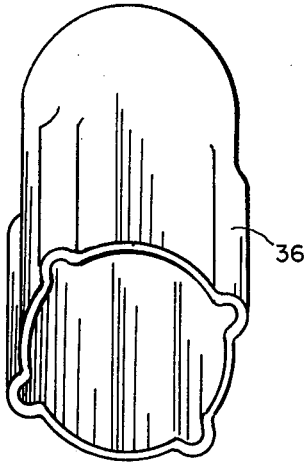
FIG. 2 is a perspective of a typical air dome as used in the aforementioned patent having four hollow side flutes and substantially as used in the present invention, but with the baffle disk omitted.

Air domes 30 and 33 are force fitted into the inlet and outlet chambers, respectively, and as seen in FIG. 2, illustrating a typical air dome, the hollow side flutes 36 frictionally engage the cylindrical walls of the chambers to hold the air domes in place. The cylindrical spacing between the flutes provides flow passages exteriorly of the air dome, as in U.S. Pat. No. 3,224,377.

Figure 3:
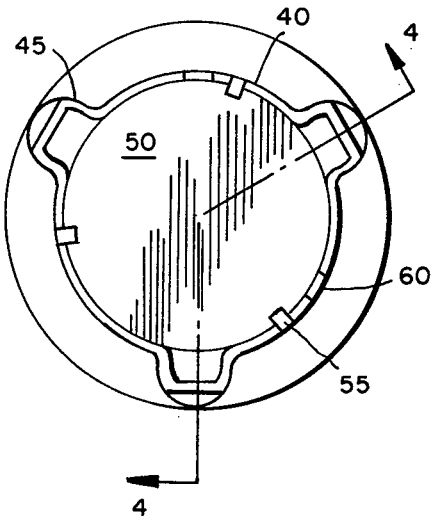
FIG. 3 is a bottom end view of an air dome in this instance using three hollow side flutes with a solid baffle plate fixed at the entrance.
Figure 4:
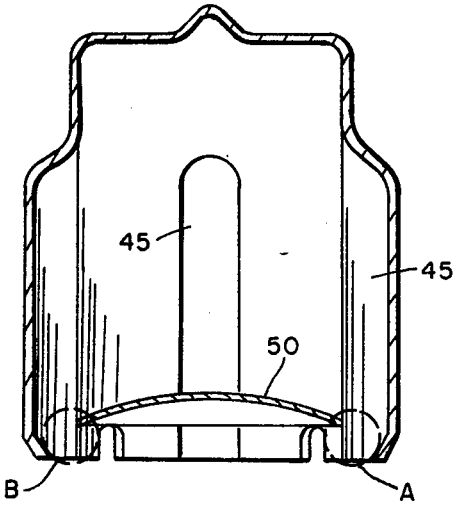
FIG. 4 is a section in elevation through IV—IV of FIG. 3.

By comparison with FIG. 3, some modification of the air dome has been made in that the air dome 40 in FIG. 3 has three side flutes 45 rather than four as shown in FIG. 2, but such change in construction is not of patentable significance herein. As seen in FIGS. 3 and 4, a solid flow baffle disk or plate 50 closes essentially almost all the open bottom area of air dome 40 except for the three passages there into at the periphery of the disk afforded by flutes 45.

Figure 6:
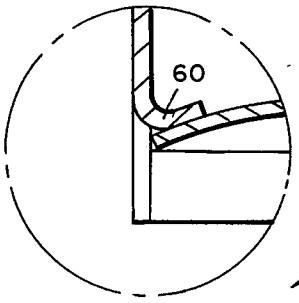
FIG. 6 is an enlarged illustration of the portion shown in the phantom circle B of FIG. 4.
Figure 5:
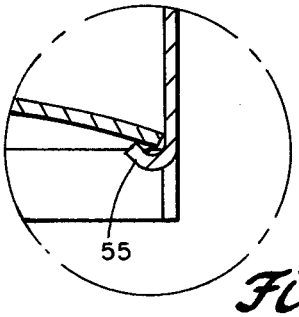
FIG. 5 is an enlarged illustration of the portion shown in the phantom circle A of FIG. 4.

As seen in FIG. 4, the disk is preferably dished for rigidity and is secured in place as seen in FIGS. 5 and 6 by re-entrant tabs such as 55 and 60 turned inwardly from the cylindrical wall of the air dome above and below the disk 50. Such holding tabs are spaced in pairs around the periphery at three points, as shown in FIG. 3, to securely hold baffle plate 50 in place.

In operation it will be apparent in visualizing the fuel flow directly upwardly toward the air dome from inlet 15 that such flow can enter only through the flutes 45 and while compressing air in the air dome any air that may have a tendency to be pushed downwardly and thus washed out would be substantially retained by the solidity of disk 50 at the entire central area which has been found to be the main channel for air washout. Air washout is due not only to the flushing effect of flow into the dome, but also the siphon effect of flow around the dome and this is substantially blocked off by the disk. In practice, this simple construction has been found to greatly overcome the problem of air washout since the restricted passages for influx of fuel provided by the flutes, while sufficient to permit a discharge rate into the air dome to compress air, do not at the same time permit air egress in any quantity to seriously affect the function of the air dome, as has been found to have been the case where virtually the entire mouth of the air dome was open, even when crossed by screen material, as conventionally done.

While the baffle disk has been found to be of special importance in connection with pumps where an air dome and fuel inlet are coaxial, as in FIG. 1, it will be appreciated that air washout could also occur for fluid moving under the impetus of the pump diaphragm to the outlet. Thus, in outlet flow, it will be appreciated that there is a measure of protection against air washout afforded.

As a practical matter, since as taught in U.S. Pat. No. 3,224,377, the air domes are of the same diameter and frequently identical, all air domes would be made with baffle disks and thus be usable and interchangeable for inlet or outlet chambers of fuel pumps regardless of orientation.

What is claimed is:

1. A fuel pump comprising a housing having an inlet chamber and an outlet chamber with an air dome in each chamber; each air dome being provided with circumferentially spaced hollow flutes to effect flow passages between said air dome and the walls of the respective chamber, the improvement which comprises a non-perforated baffle disk across the entrance opening of the air dome in the inlet chamber whereby said air dome has fuel flow thereinto only through said flutes at the edge of said disk to trap air in said air dome and whereby washing out of air from said air dome is substantially prevented by said disk; wherein said fuel pump has a fuel inlet port effecting fuel flow directly towards the air dome opening in said inlet chamber.

2. In a fuel pump as set forth in claim 1, including an identical non-perforated disk across the opening to the air dome in said outlet chamber.

3. In a fuel pump as set forth in claim 1, wherein said fuel inlet port and said air dome in said inlet chamber are coaxial.

* * * * *